US009617815B2

(12) United States Patent
Schwartze et al.

(10) Patent No.: US 9,617,815 B2
(45) Date of Patent: Apr. 11, 2017

(54) DOWNHOLE TOOLS WITH INDEPENDENTLY-OPERATED CUTTERS AND METHODS OF MILLING LONG SECTIONS OF A CASING THEREWITH

(71) Applicants: Sascha Schwartze, Sandnes (NO); Ole Petter Nipen, Bergen (NO); Carl C. Clemmensen, Bergen (NO); Corinna Schwartze, Sandnes (NO)

(72) Inventors: Sascha Schwartze, Sandnes (NO); Ole Petter Nipen, Bergen (NO); Carl C. Clemmensen, Bergen (NO); Corinna Schwartze, Sandnes (NO)

(73) Assignee: BAKER HUGHES INCORPORATED, Houston, TX (US)

( * ) Notice: Subject to any disclaimer, the term of this patent is extended or adjusted under 35 U.S.C. 154(b) by 408 days.

(21) Appl. No.: 14/223,431

(22) Filed: Mar. 24, 2014

(65) Prior Publication Data

US 2015/0267493 A1 Sep. 24, 2015

(51) Int. Cl.
*E21B 29/06* (2006.01)
*E21B 29/00* (2006.01)

(52) U.S. Cl.
CPC ..... *E21B 29/005* (2013.01)

(58) Field of Classification Search
CPC ..... E21B 47/08; E21B 29/00; E21B 29/006; E21B 29/06; E21B 29/10
See application file for complete search history.

(56) References Cited

U.S. PATENT DOCUMENTS 6,920,923 B1 * 7/2005 Pietrobelli ..... E21B 29/005 166/55.2
2005/0241856 A1 11/2005 Lassoie et al.
2010/0139981 A1 * 6/2010 Meister ..... E21B 7/04 175/61
2011/0220357 A1 * 9/2011 Segura ..... E21B 29/005 166/298
2011/0278064 A1 11/2011 Rasheed
2013/0168076 A1 7/2013 Davis
2013/0199785 A1 8/2013 Hekelaar
2014/0027117 A1 * 1/2014 Hekelaar ..... E21B 43/112 166/297

FOREIGN PATENT DOCUMENTS

WO 2012170806 A1 12/2012

OTHER PUBLICATIONS

PCT International Search Report and Written Opinion; International Application No. PCT/US2015/017219; International Filing Date: Feb. 24, 2015; Date of Mailing: Jun. 11, 2015; pp. 1-16.

* cited by examiner

*Primary Examiner* — Brad Harcourt
(74) *Attorney, Agent, or Firm* — Cantor Colburn LLP

(57) ABSTRACT

In one aspect, an apparatus for use in a wellbore is disclosed that in one non-limiting embodiment includes a plurality of cutters, each cutter having expandable cutting elements, a control unit associated with each cutter to expand the cutting elements of its associated cutter and a controller that controls each of the control units to independently activate and deactivate each cutter in the plurality of cutters to expand the cutting elements of each such cutter.

16 Claims, 2 Drawing Sheets

DOWNHOLE TOOLS WITH INDEPENDENTLY-OPERATED CUTTERS AND METHODS OF MILLING LONG SECTIONS OF A CASING THEREWITH

BACKGROUND

1. Field of the Disclosure

This disclosure relates generally to apparatus and methods for cutting or milling a casing or another element within a wellbore and retrieving cut elements to the surface.

2. Background of the Art

Wellbores are drilled in subsurface formations for the production of hydrocarbons (oil and gas). Modern wells can extend to great well depths, often more than 15,000 ft. A wellbore is typically lined with casing (a string of metal tubulars connected in series) along the length of the wellbore to prevent collapse of the formation (rocks) into the wellbore. Sometimes it is necessary to cut away part of the casing at one or more locations and then remove the cut portion to the surface. At other times it is necessary to mill one or more long sections of the casing. To perform a cutting and pulling operation, a tool with a cutter is typically conveyed into the casing to cut away part of the casing at a desired location. A spear, either as a part of a tool that includes the cutting tool or conveyed separately from the surface, is attached to the inside of the casing above the cut-away portion is then pulled uphole to pull the casing out of the hole. Currently available cutters are not capable of milling very large sections of a casing because cutting elements degrade to a level such that further milling is not feasible. Therefore, several trips are made into the wellbore with cutter replacements to mill long sections, which can result in excessive non-productive time. Therefore, it is desirable to have a tool capable of making multiple cuts in a casing or milling a long section or more than one section of a casing during a single trip into the wellbore.

The disclosure herein provides apparatus that includes more than one cutter that can be independently activated and deactivated to perform multiple cutting operations and milling long casing sections in a closed loop manner during a single trip into the wellbore.

SUMMARY

In one aspect, an apparatus for use in a wellbore is disclosed that in one non-limiting embodiment includes: a plurality of cutters, each cutter having expandable cutting elements; a control unit associated with each cutter to expand the cutting elements of its associated cutter; and a controller that controls each of the control units to independently activate and deactivate its associated cutter in the plurality of cutters to expand the cutting elements of each such cutter.

In another aspect, a method of milling a casing in a wellbore is disclosed that in one non-limiting embodiment includes: conveying a tool inside the casing, the tool including a plurality of cutters configured to mill the casing; locating a first cutter in a plurality of the cutters at a first location in the casing; activating the first cutter to engage with the casing at the first location; milling the casing with the first cutter to a second location; deactivating the first cutter; positioning a second cutter in the plurality of cutters at the second location; activating the second cutter to engage with the casing at the second location; and milling the casing with the second cutter to a third location.

Examples of the more important features of certain embodiments and methods according to this disclosure have been summarized rather broadly in order that the detailed description thereof that follows may be better understood, and in order that the contributions to the art may be appreciated. There are, of course, additional features that will be described hereinafter and which will form the subject of the claims.

BRIEF DESCRIPTION OF THE DRAWINGS

For a detailed understanding of the apparatus and methods disclosed herein, reference should be made to the accompanying drawings and the detailed description thereof, wherein like elements are generally given same numerals and wherein.

DETAILED DESCRIPTION OF THE DRAWINGS

Figure 1:
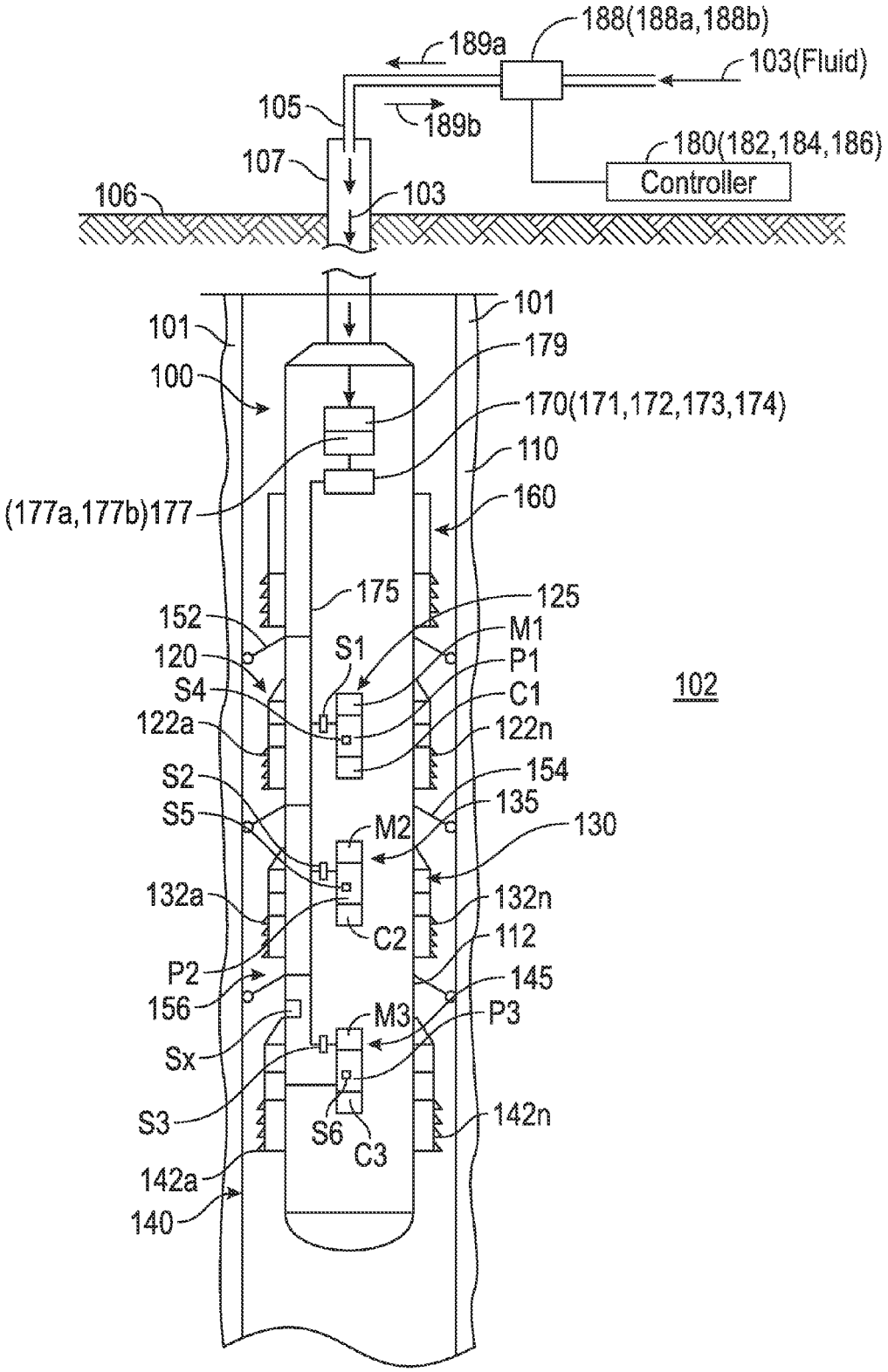
FIG. 1 shows a line diagram of a non-limiting embodiment of a cut and pull tool that includes a number of independently-operated cutters or mills for milling long sections of casings and other tubulars in a wellbore.

FIG. 1 shows a line diagram of a non-limiting embodiment of a cut and pull or retrieve tool 100 (also referred herein as the "tool" or "bottom hole assembly" or "BHA") disposed in a wellbore 101 formed in a formation 102 from a surface location 106. The wellbore 101 is lined with a casing 110. The tool 100 is shown conveyed in the casing 110 by a tubular 107 that may be rotated by a suitable turn table or a top drive (not shown) to rotate the tool 100. A fluid 103 is supplied under pressure into the tubular 107 and thus to the tool 100 during operation of the tool 100. A controller 180 at the surface 106 (also referred to as the surface controller) is provided to transmit command signals and other data to a controller 170 in the tool 100 (also referred to as the downhole controller). In one aspect, the controller 180 is a computer-based system that may include electrical circuits, one or more processors 182, computer programs and data 184 stored in a storage device 186, such as a memory device, accessible to the processor 182 to determine values of various parameters relating to the tool 100 and surface operations and provide command signals to the controller 170 for controlling the operations of the tool 100, in accordance with the computer programs 184. A telemetry device or unit 188 may be provided to transmit data and command signals to a telemetry device or unit 177 in the tool 100. Any suitable telemetry technique known in the art may be utilized, including, but not limited to, acoustic telemetry using mud pulses and electromagnetic waves. In one aspect, the telemetry device 188 may include a pressure signal generator 188*a* (also referred to herein as a "pulser") to generate pressure signals 189*a* in the fluid 103 in accordance with the instructions provided by the controller 180. The telemetry device 177 may include a receiver 177*a*, such as a pressure detector or flow detector, to detect the pressure pulses 189*a* and to provide such detected signals to the controller 170. The telemetry device 177 further may include a pressure pulse generator 177*b* that generates pressure pulses 189*b* in accordance with the instructions provided by controller 170. A receiver 188*b* in the telemetry device 188 detects the pressure pulses 189*b* and provides such information to the processor 182. Thus, telemetry units 177 and 188 along with the controllers 170 and 180 provide two-way data and signal communication between the tool 100 and the surface 106.

Still referring to FIG. 1, the tool 100 includes two or more cutters (also referred to as mills), such as cutters 120, 130 and 140. Each such cutter may further include a number of cutting elements (also referred to as blades or cutting members) that extend radially (i.e. outward) from the outer surface 112 of the tool 100 to make contact with the casing 110. For example, cutter 120 may include extendable cutting elements 122*a* through 122*n*, cutter 130 may include extendable cutting elements 132*a* through 132*n* and cutters 140 may include cutting elements 142*a* through 142*n*. In aspects, the cutting elements of different cutters may be of different types to perform different cutting operations. For example cutters 120 and 130 may be configured to mill a casing while cutter 140 may be configured to cut the casing 110 or a fish, wherein cutter 140 may be further configured to extend beyond the other cutters to cut casings of different sizes in the same wellbore. The term "fish" refers to any member, device or element in a wellbore identified as a candidate to be cut, milled or removed from the wellbore. Each cutter further includes a separate control device or control unit configured to extend its corresponding cutter, as described in more detail below. In FIG. 1, control unit 125 is associated with cutter 120, control unit 135 with cutter 130 and control unit 145 with cutter 140. In one aspect, control unit 125 includes a motor M1 that drives a pump P1, which supplies a fluid (such as oil) from a source or chamber C1 to each of the cutting elements 122*a*-122*n* to cause such elements to expand to contact the casing 110. The pressure of the supplied fluid is sufficient to cause the cutter elements 122*a*-122*n* to cut or mill the casing 110 or another member in the wellbore 101. Similarly, control unit 135 associated with cutter 130 includes a motor M2, pump P2 and fluid chamber C2, while control unit 145 associated with cutter 140 includes a motor M3, pump P3 and fluid chamber C3. A device such as a switch S1 or another suitable device controls the operation of the motor M1, device S2 controls the operation of the motor M2 and a device S3 controls the operation of the motor M3. A sensor may be incorporated to provide signals relating to the pressure applied by each cutter onto the casing or the fish or the radial distance of the cutting elements. For example, sensors, such as pressure sensors S4, S5 and S6 respectively may provide pressure measurements for the cutters 120, 130 and 140. Additional sensors, collectively designated as Sx are provided to determine various parameters, including, but not limited to, temperature of the cutting elements and vibration and whirl of the tool 100 to determine in real-time the physical condition of the cutter.

Still referring to FIG. 1, a sensor or devices may be provided above each cutter to measure the inside dimensions of the casing or the wellbore above or uphole of each cutter. Such a device may include, but is not limited to, a tactile caliper 152 above cutter 120, tactile caliper 154 above cutter 130 and tactile caliper 156 above cutter 140 or it may include an acoustic device for providing extension of the cutting elements relative to a reference point, such as the center of the tool 100. Any other suitable device known in the art may also be utilized to determine the extension of the cutters and the pressure or force applied by such cutters on the casing or the fish. The tool 100 further may include a spear, such as spear 160, to engage with the casing above the cutters to pull the casing or another fish from inside the wellbore to the surface. Any suitable spear known in the art, including spears that can be activated and deactivated by rotation, may be utilized for the purpose of this disclosure. For example, the spear may be configured to activate and engage with the fish when the tool 100 is rotated in a first direction, for example clockwise, and disengaged from the fish when the tool 100 is rotated in a second direction, for example anti-clockwise. Such spears are known in the art and are thus not described in detail herein. The spear 160 also may be operated hydraulically, such as by motor, pump and a fluid source as described in references to the devices 125, 135 and 145.

Still referring to FIG. 1, in one aspect, the controller 170 controls the operations of the various devices in the tool 100, such as the cutters 120, 130, 140 and spear 160, and determines parameters, such as pressure, from measurements provides by sensors S4, S5 and S6, extensions of the calipers 125, 135 and 145, physical parameters from sensors Sx and provides two-way communication between the tool 100 and the surface controller 180. In one aspect, the controller 170 includes: electrical circuits 171 for processing sensor signals and operating switches S1-S3; a microprocessor 172 that determines parameter values (pressure, etc.) from sensor signals and generates instructions for operating various devices based on programs 173 stored in a storage device 174, such as a solid state memory, or in response to signals received from the surface controller 180. An electrical bus 175 may be utilized to couple the controller 170 to the various devices and sensors in the tool 170, including cutters 120, 130 and 140, sensors S1-S6 and Sx and calipers 152, 154 and 156 to provide communication between such devices and sensors and the controller 170. Controller 170 may determine various parameters and operate the devices in the tool 170. In another aspect, the tool 100 further includes an electrical or power generator 179 driven by the flow of the fluid 103 through the tool 100 to generate electrical energy (power) during operation of the tool 100, which electrical energy power is supplied to the various devices and sensors in the tool 100.

Still referring to FIG. 1, to cut or mill a portion of the casing 110 or another fish, fluid 103 is supplied from the surface via a conduit 105, which fluid operates the power generator 179. The generated power is supplied to all the electrical components of the tool 100, including the pulser 177*b*, downhole controller 170, motors M1, M2 and M3 and sensors S1-S6 and Sx. Instead of controller 170, controller 180 may determine from the signals of the sensors in the tool 100 the values of the parameters relating to the various devices in the tool 100 and may send commands to the downhole controller 170 via the telemetry unit 188. Alternatively, both controllers 170 and 180 may perform such functions in part. Controller 180 may send commands to the controller 170 via the telemetry unit 188. The controller 170 interprets the commands or the messages from the controller 180 and in accordance therewith and the programs 173 operates the cutters in the tool. Thus, the cutters in the tool 170 may be activated and deactivated independently in real time on demand to perform the cutting and milling operations. The tool 100 can be positioned at any suitable location in the wellbore 100, can selectively or independently activate or operate any of the cutters, cut a casing or fish and mill a section of the casing. The tool 100 may then be moved to another location. The same or a different cutter may then be activated to cut or mill another section of the casing. As noted earlier, currently available cutters or mills are able to cut a certain length of the casing and to cut long casing sections, then the tool is retrieved from the wellbore to replace the cutter and then redeployed into the wellbore to mill additional casing. In some cases, multiple trips of the cutting tool into the wellbore are made to cut relatively long casing sections, thereby increasing the non-productive time for performing the milling operations. Furthermore, currently available cutters do not provide real-time information about the inner dimensions of the wellbore above the cutter while milling the casing. The cutting tool 100 according to the disclosure herein may include multiple cutters, which may include different types of cutting elements, wherein each cutter can be independently activated and deactivated from a surface location to perform various cutting and milling operations during a single trip of the tool 100 into a wellbore. The tool also provides real-time diagnostics information relating to physical parameters (pressure, temperature, vibration, whirl, etc.) of the cutters and the tool during cutting/milling operations.

Figure 2:
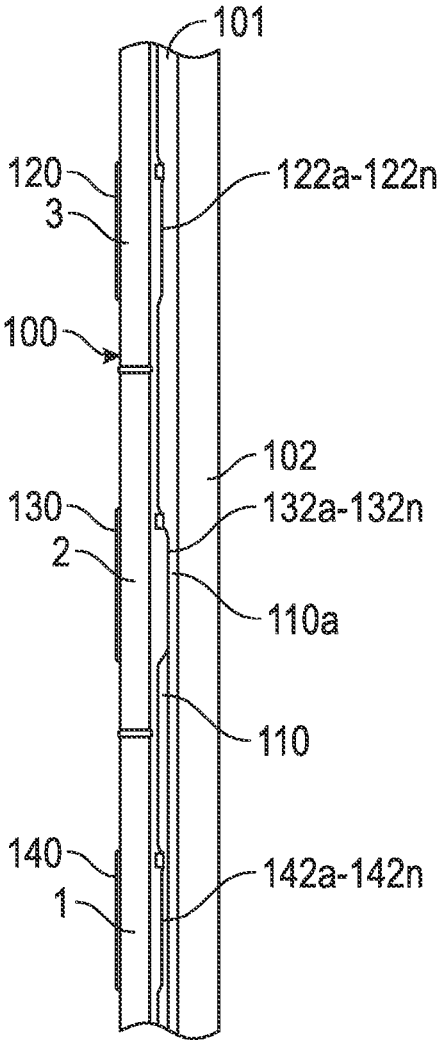
FIGS. 2 and 3 show an exemplary sequence of operations of milling a long section of a casing using the cut and pull tool shown in FIG. 1.
Figure 3:
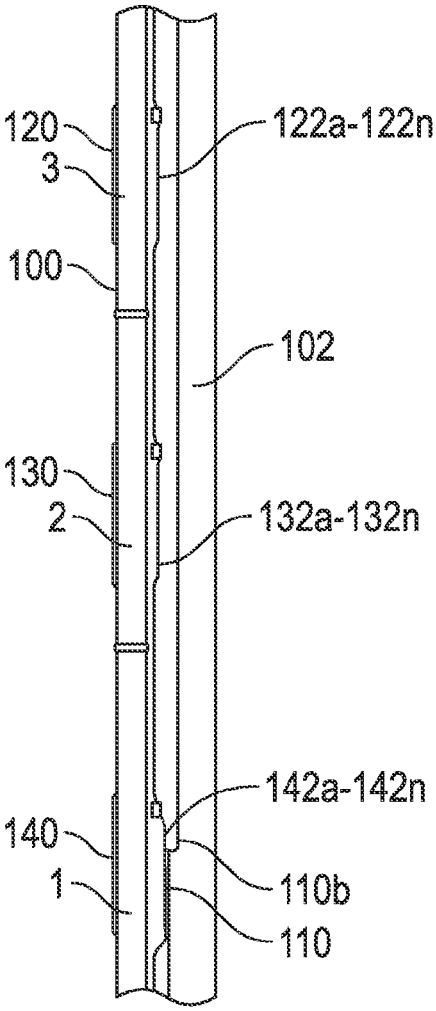

FIGS. 2 and 3 show use of the tool 100 for milling a number of casing sections (in this particular example three consecutive sections) so as to mill a relatively long section of the casing 100 that would generally not be obtainable with a single currently available cutter. FIG. 2 shows the tool 100 deployed in the wellbore 101 having the casing 110 therein. In FIG. 2, the cutter 120 has been used to mill a section of the casing 110 from a location above 110*a* to the location 110*a*. The cutting elements 122*a*-122*n* have been retracted, as shown in FIG. 2. At the termination of milling of the casing 110 to location 110*a*, the cutter 120 would have been at the location 110*a*. In FIG. 2, the tool has been pulled uphole so as to locate the cutter 130 at location 110*a*. Referring now to FIGS. 1 and 2, after locating the cutter 130 at location 110*a*, the controller 170 alone or in response to commands from controller 180 activates the cutter 120 via the sensor S2 to expand the cutting elements 132*a*-132*n* to contact the casing 110 as shown in FIG. 2, while the cutters 120 and 140 remain in their retracted or deactivated state. The tool 100 is then rotated by rotating the tubular 107 while the fluid 103 is circulating in the wellbore to mill the casing 110 staring at location 110*a*. The sensors S5 and Sx provide measurements to the controller 170, which determines the various parameters relating to the milling operations or transmits the data to the controller 180 for determining such parameters. The controller 170 and/or controller 180 stops the milling operation with the cutter 130, based on the information relating to the cutter condition (also referred to as the "health" of the cutter) or other parameter(s) and deactivates the cutter 130 to retract the cutting elements 132*a*-132*n* at location 110*b* of the casing, as shown in FIG. 3. An operator at the surface also may look at one or more parameters and input instructions for the controllers 180 and/or 170 to deactivate the cutter 130. After cutter 130 has been deactivated, the tool 100 may pulled up so as to locate the cutter 140 at location 110*b*, as shown in FIG. 3. The cutter 140 may then be activated to mill the casing 110 starting at location 110*b* in the manner described above in reference to FIG. 2. Thus, in one aspect, the tool 100 may be utilized to mill multiple sections of a casing using multiple independently operable cutters during a single trip in the wellbore, i.e., without retrieving the cutting tool 100.

In another aspect, the tool 100 may be utilized to cut and pull the casing. In this case, the tool is activated to engage the spear 160 at a selected location, a particular cutter is then activated to cut the casing, while the tool 100 is under tension (i.e. while the tool 100 is being pulled). The cut section of the casing is then retrieved to the surface by tripping out the tool 100 while the spear 160 is still engaged with the casing 110.

The foregoing disclosure is directed to the certain exemplary embodiments and methods of a cut and pull tool. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A method of milling a casing in a wellbore, comprising:
conveying a tool inside the casing, the tool including a plurality of cutters configured to mill the casing;
locating a first cutter in the plurality of the cutters at a first location in the casing;
activating the first cutter to engage with the casing at the first location;
milling the casing with the first cutter to a second location and deactivating the first cutter;
positioning a second cutter in the plurality of cutters at the second location;
activating the second cutter to engage with the casing at the second location;
milling the casing with the second cutter to a third location; and
determining a physical condition of at least one of the first cutter and the second cutter utilizing information about a measured inner dimension of the casing above the at least one of the first cutter and the second cutter while such cutter is milling the casing and deactivating such cutter when the physical condition of such cutter is below a desired condition.

2. The method of claim 1 further comprising determining in real time an inner dimension of the wellbore above one of the first cutter and the second cutter while such cutter is milling the casing.

3. The method of claim 2, wherein determining the inner dimension comprises using a device selected from a group consisting of: a tactile caliper; and an acoustic device.

4. The method of claim 1, wherein the tool further includes a spear configured to engage with the casing to pull the casing from the hole, wherein the method further comprises:
engaging the spear with the casing above the milled casing and pulling the tool to pull the casing out of the wellbore.

5. The method of claim 1 further comprising providing a two-way communication between the tool and a surface location by one of: mud pulse telemetry; and electromagnetic telemetry.

6. A method of milling a casing in a wellbore, comprising:
conveying a tool inside the casing, the tool including a plurality of cutters configured to mill the casing;
locating a first cutter in the plurality of the cutters at a first location in the casing;
activating the first cutter to engage with the casing at the first location;
milling the casing with the first cutter to a second location and deactivating the first cutter;
positioning a second cutter in the plurality of cutters at the second location;
activating the second cutter to engage with the casing at the second location; and milling the casing with the second cutter to a third location, wherein activating one of the first cutter and the second cutter includes using a controller to control a control device associated with the one of the first cutter and the second cutter, the control device including a motor that drives a pump to supply a fluid under pressure to expand cutting elements of the one of the first cutter and the second cutter.

7. The method of claim 6, wherein the controller is located at one of: in the tool; at the surface; and partially in the tool and partially at the surface.

8. An apparatus for use in a wellbore, comprising:

a plurality of cutters, each cutter having expandable cutting elements;

a control unit associated with each cutter to expand the cutting elements of its associated cutter;

a controller that controls each control unit to independently activate and deactivate each cutter in the plurality of cutters to expand the cutting elements of each such cutter; and a device that provides measurements relating to an inner dimension of the wellbore above at least one of the cutters in the plurality of cutters, wherein the controller determines a physical condition of at least one of the cutters in the plurality of cutters from measurements of an inner dimension in the wellbore while such cutter is milling an element in the wellbore.

9. The apparatus of claim 8, wherein the device that provides measurements of the inner dimension of the wellbore is selected from a group consisting of: a caliper; and an acoustic device.

10. The apparatus of claim 8 further comprising a spear configured to engage with a fish in the wellbore to pull the fish out of the wellbore.

11. The apparatus of claim 8 further comprising a telemetry system that provides two-way communication between a tool carrying the cutters while the tool is in the wellbore and surface location.

12. The apparatus of claim 11, wherein the telemetry system provides the two-way communication via one of: mud pulse telemetry; and electromagnetic telemetry.

13. An apparatus for use in a wellbore, comprising:

a plurality of cutters, each cutter having expandable cutting elements;

a control unit associated with each cutter to expand the cutting elements of its associated cutter; and a controller that controls each control unit to independently activate and deactivate each cutter in the plurality of cutters to expand the cutting elements of each such cutter, wherein each control unit includes a motor that drives a pump to supply a fluid under pressure to expand the cutting elements of its associated cutting elements.

14. The apparatus of claim 13, wherein the controller is located at one of: in a tool that contains the cutters; at a surface location; and both at the surface location and in the tool.

15. The apparatus of claim 14 further comprising one or more sensors that provide information about a parameter of interest relating to a physical condition of a tool carrying the plurality of cutters while a cutter in the plurality of cutters is performing a cutting operation.

16. The apparatus of claim 15, wherein the controller determines the physical condition of the tool from the information provided by the one or more sensors and in response thereto controls the operation of at least one cutter.

* * * * *